United States Patent [19]

Farran et al.

[11] Patent Number: 4,913,423

[45] Date of Patent: Apr. 3, 1990

[54] EXERCISE FURNITURE

[76] Inventors: Mitchell R. Farran, 736 Bristol N.W., Grand Rapids, Mich. 49504; Marc G. Farran, 2252 Walker Ave., Walker, Mich. 49504

[21] Appl. No.: 202,408

[22] Filed: Jun. 6, 1988

[51] Int. Cl.[4] ..... A63B 21/00; A47C 7/62

[52] U.S. Cl. ..... 272/134; 272/144; 5/508; 297/217

[58] Field of Search ..... 272/134, 138, 142, 144, 272/135, 136, 137; 297/217, 194; 5/508

[56] References Cited

U.S. PATENT DOCUMENTS

| | | | |
|---|---|---|---|
| 852,193 | 4/1907 | McMillan | 272/142 |
| 3,558,131 | 1/1971 | Dragon | 272/142 |
| 3,738,649 | 6/1973 | Miller | 272/142 |
| 3,893,667 | 7/1975 | Snyder et al. | 297/217 |
| 4,478,413 | 10/1984 | Siwula | 272/138 |

*Primary Examiner*—Stephen R. Crow

*Attorney, Agent, or Firm*—Price, Heneveld, Cooper, DeWitt & Litton

[57] ABSTRACT

A furniture article, such as a seating article, for residential and office use that includes a frame housing, one or more exercise apparatus that are located in the armrest, the back and the seating base. The frame is selectively covered to provide the seating article with the appearance of a conventional furniture article used in the home or office. Each exercise apparatus employs a cable extending through the covering to communicate a source of resistive force from within the frame to a user outside of the frame. On the end of the cable outside of the covering is a handle or a foot stirrup by which the user pulls the cable out of the seating article. A cover conceals the handle or foot stirrup as well as the end of the cable while the exercise aspects of the furniture article are not being utilized.

31 Claims, 2 Drawing Sheets

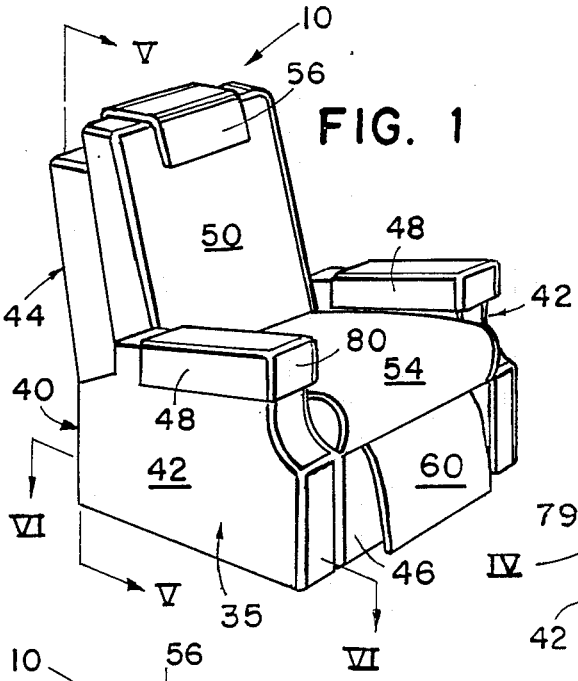
FIG. 1
FIG. 2
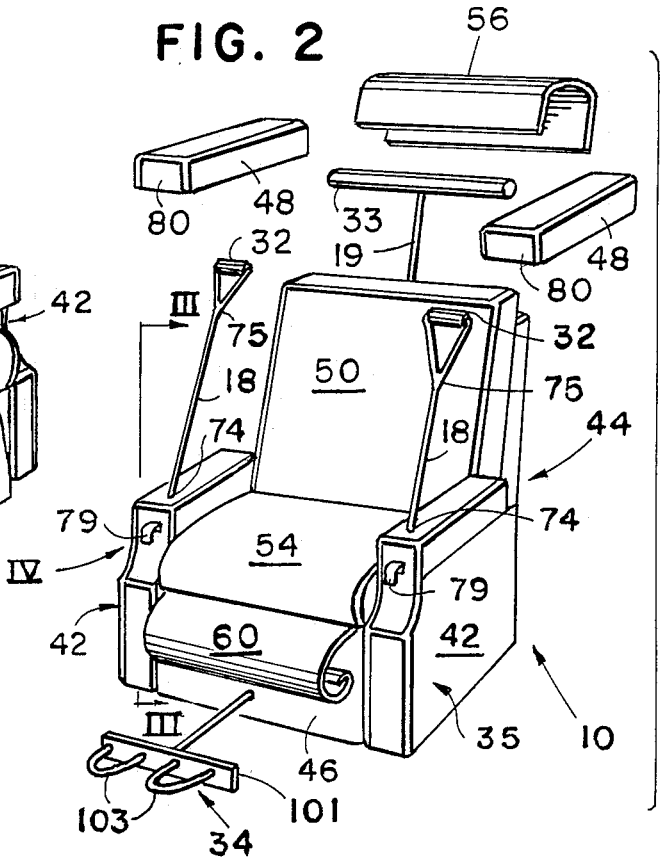
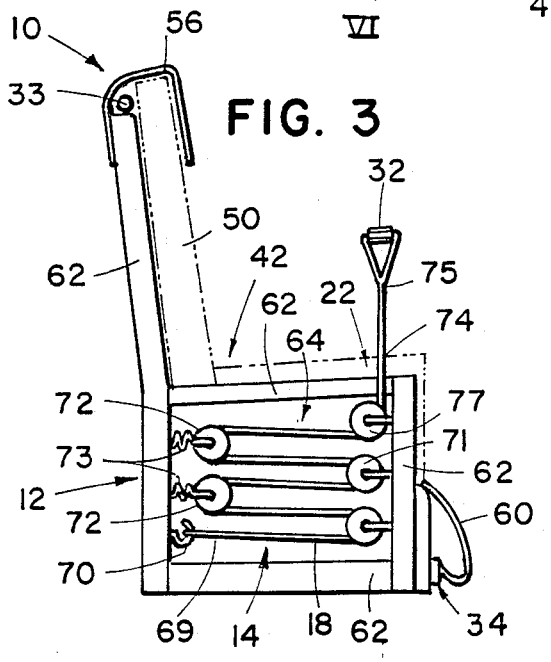
FIG. 3
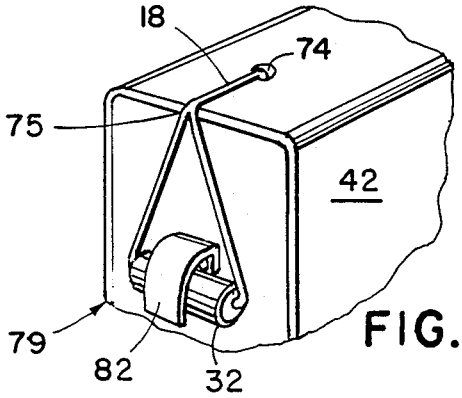
FIG. 4
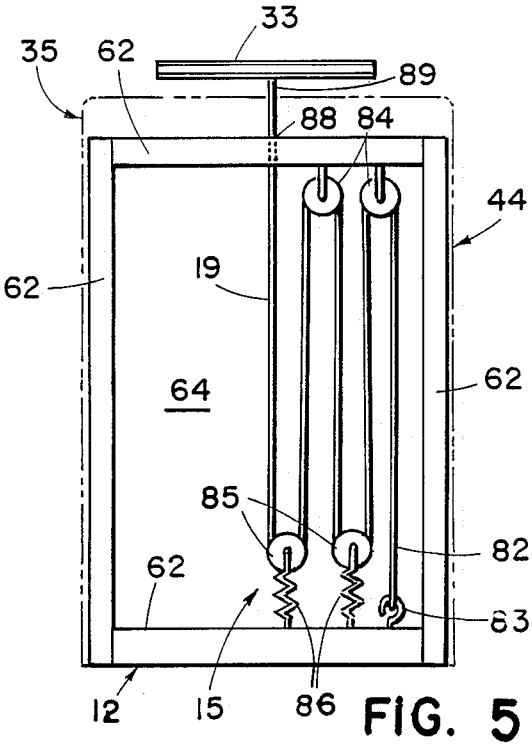
FIG. 5

FIG. 6
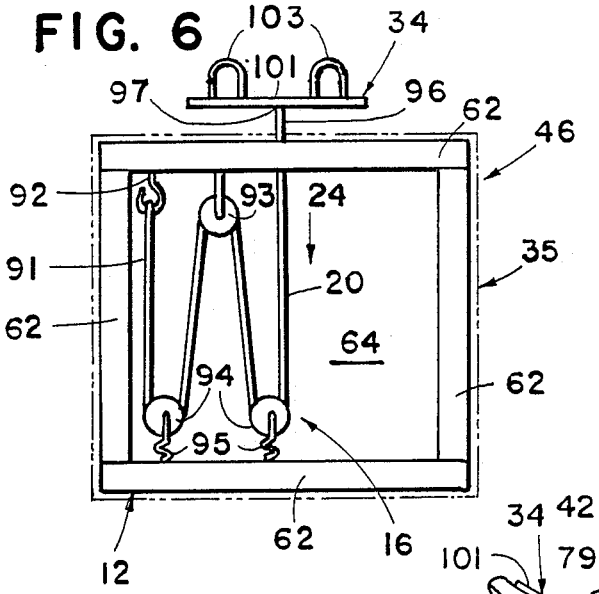
FIG. 7
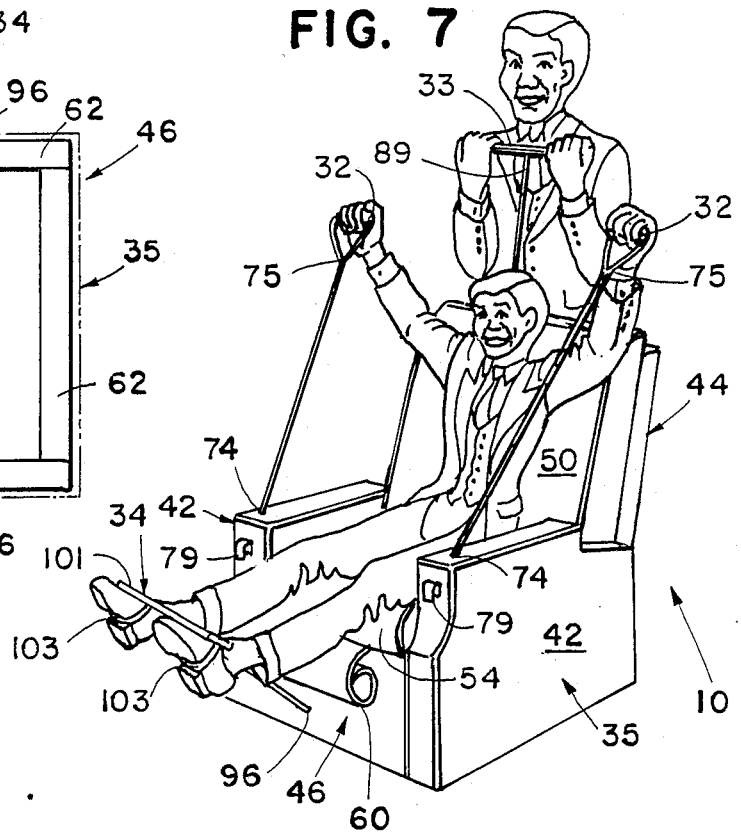
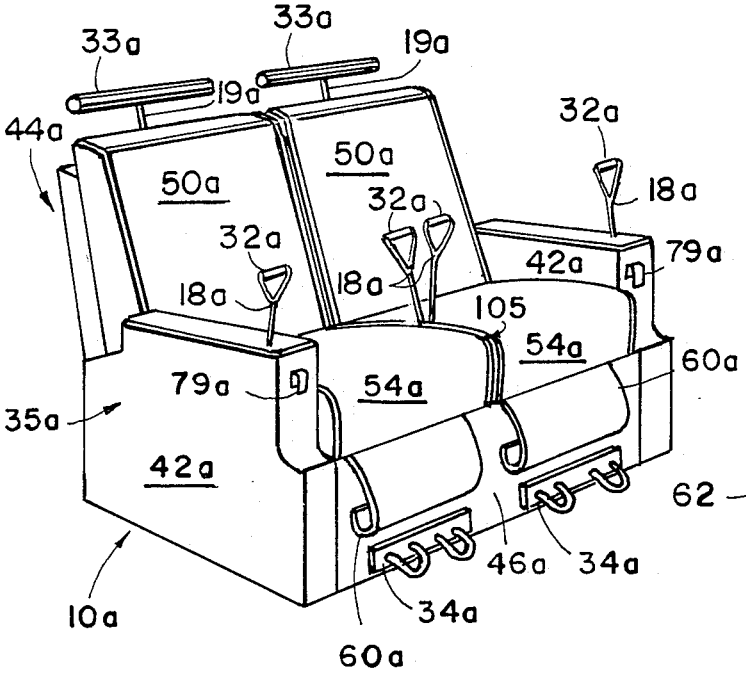
FIG. 8
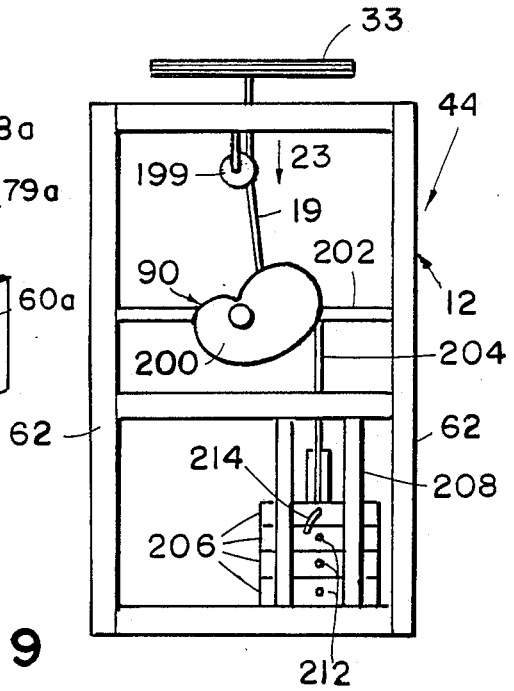
FIG. 9

EXERCISE FURNITURE

BACKGROUND OF THE INVENTION

The present invention relates to exercising apparatus, and in particular to exercise machine-type apparatus that incorporate weights, springs, hydraulics or other force generating elements.

As a result of increasing interest in health and personal exercise, a wide variety of exercise equipment have been developed both for commercial and home use. Among these various prior exercising devices are a number of different general types or classes of equipment that have been designed in order to respond to the variety of different exercise needs, differences in personnel using the equipment and differing theories as to exercising techniques themselves. One such general type of exercise equipment is that incorporating free weight systems. In such free weight systems a metal bar serves as a lifting handle and has weight elements that are either removably or fixedly mounted on each end. A variety of different racks, presses and user supporting equipment have been developed to accommodate these free weights, either as storage mechanisms or exercise devices that support the free weights while the free weights are in use. For example, bench presses and the like incorporate a bench-like support with a bar supporting rack that support both the person exercising and the free weight bar.

Another class or type of exercise apparatus are ones which themselves incorporate some weight or force generating elements rather than requiring separate free weights to be used with the device. Typically such exercise machine-type apparatus incorporate a floor standing frame on which levers, cables, springs or the like are mounted and which are coupled to weight elements, springs, hydraulic cylinders or the like in order to resist movement. Handles, pads, foot straps and the like are secured to the lever or cable so that the user may, for example, grasp the handle and push the lever against the resisting force. Such machine-type exercise equipment have been developed for various different exercises, and therefore this type of equipment incorporates benches, seats, platforms and the like on which the user sits, lays or stands during use depending upon the particular exercise to be performed.

Although exercise equipment such as free weight devices or exercise machine-type apparatus are generally effective for providing the intended exercise, these pieces of equipment are normally relatively large, space consuming apparatus that are both expensive and unsightly. Heretofore such exercise machines have typically been kept by a private owner in a separate exercise room or area due to the unsightly appearance of such equipment and its function solely as a piece of exercising equipment. Since the exercise equipment is kept in a separate room, a user is at least to some degree precluded from performing other activities unrelated to exercising while he or she is using the exercise equipment. While using the equipment the user is isolated from other persons not exercising and is also removed from normal living areas where the user could otherwise perform other activities such as watch television or the like.

Another problem associated with such prior exercise machine is its relative expense, particularly in view of the limited amount of time that any given individual uses such a piece of equipment. For this reason many individuals prefer to join commercial athletic or health clubs having a number of such exercise machines, rather than attempting to purchase these bulky and expensive pieces of equipment themselves. Although such commercial athletic clubs may be equipped with a number of such exercise machines, their use requires a person pay club membership fees, and again, the user is forced to go to the club to exercise. This forecloses a person from interspersing his or her exercise activities with other activities, and also requires that a substantial block of time be devoted to this exercising activity.

SUMMARY OF THE INVENTION

The present invention is embodied in a furniture article aesthetically designed for use in a residential or office setting which also incorporates exercise apparatus for additional use as an exercising machine. The furniture article includes a furniture frame, such as one adapted for seating the user, with an exercise element that is movably coupled to the frame. A mechanism for providing a resistive force to movement of the exercise element is coupled to the exercise element. The frame, along with the resisting force mechanism, is covered to provide the furniture article with a conventional furniture appearance. The exercise element is selectively coupled to the user, such as by a handle, foot stirrup or the like, so that in use in the exercise equipment mode the user moves the exercise element while being resisted by the resisting force mechanism. Preferably, a covering element conceals the coupling apparatus and exercise element while not in use in the exercise mode. The furniture article therefore provides the dual function of an exercise machine and a conventional residential or office furniture article.

In another aspect of the invention, a cable has one end secured to the covered furniture frame with the other end extending out through an aperture in the covering. A resistance spring assembly resists the withdrawal of the cable through the aperture, while the cable is tracked around a plurality of pulleys within the furniture article in order to be stored therein.

With the present furniture article, the substantial storage problems posed by other exercise machines is obviated. The furniture article may be located in any room along with other conventional articles of furniture and present an aesthetically pleasing appearance in keeping with the surrounding decor. Nonetheless, the furniture article may be used for a wide variety of exercises. Since the exercise equipment is not located in a separate room, exercising can be accomplished while performing other activities. For example, other leisure activities such as watching television or the like can be performed while using the furniture article in an exercise mode, thus rendering what would otherwise be a rather sedentary activity into a physical operation. Due to the ease and speed with which the furniture article can be placed into the exercising mode, exercises can be performed on the furniture article for very short periods of time and can be readily interspersed with other activities. Additionally, although the exercise apparatus may be incorporated into a relatively expensive article of furniture, a user would in any event normally be required to purchase some type of conventional furniture for his or her home or office. Further, since the device also functions in the manner of a conventional furniture article, the present device will receive a substantial amount of use. Thus, the need for a separate, relatively expensive exercise apparatus having relatively limited periods of use is obviated, thereby reducing the overall expense to the user.

These and other features, advantages and objects of the present invention will be further understood and appreciated by those skilled in the art by reference to the following specification, claims and drawings appended hereto.

BRIEF DESCRIPTION OF THE DRAWINGS

FIG. 1 is a perspective view of a seating article embodying the present invention;

FIG. 2 is an exploded view of the seating article of FIG. 1;

FIG. 3 is a side cross-sectional view of the seating article taken along plane III—III in FIG. 2;

FIG. 4 is a fragmentary perspective view of a handle retainer located on an arm rest of the seating article shown in the region of arrow IV in FIG. 2;

FIG. 5 is a back cross-sectional view of the seating article taken along plane V—V in FIG. 1;

FIG. 6 is a bottom cross-sectional view of the seating article taken along plane VI—VI in FIG. 1;

FIG. 7 is a perspective view of the seating article of FIG. 1 shown in use;

FIG. 8 is a perspective view of another embodiment of the seating article;

FIG. 9 is a rear cross-sectional view of still another embodiment of the seating article.

DETAILED DESCRIPTION OF THE PREFERRED EMBODIMENTS

The present invention is embodied in a furniture article, a preferred from of which is shown in FIGS. 1 and 2 and referenced generally by the numeral 10. Furniture article 10 includes a frame 12 that houses three exercise apparatus 14, 15 and 16 (FIGS. 3, 5 and 6). Each exercise apparatus 14–16 employs a cable 18, 19 or 20, respectively, that is drawn out of frame 12 by a person using furniture article 10 in an exercise mode. Each exercise apparatus 14, 15 and 16 also includes a complimentary one of resisting mechanism 22, 23 or 24. Resisting mechanisms 22–24 are located internally to furniture article 10 on frame 12, and resist the withdrawal of cables 18–20. A handle 32, an elongated handle 33 and a set of foot stirrups 24 are connected to the outer ends of cables 18, 19, 20, respectively, in order to provide some means to grasp or couple cables 18–20 to the person using furniture article 10. Overlaying frame 12, as well as exercise apparatus 22–24, is a cover 35 that provides furniture article 10 with the appearance of a conventional furniture article used in residences, offices or the like. Furniture article 10 therefore functions not only as an exercise machine, but also as an aesthetically pleasing piece of furniture having an appearance typically associated with a residence or office.

As embodied in FIGS. 1 and 2, furniture article 10 takes the form of an easy chair having the appearance of a conventional stuffed chair used in the residence or office. Furniture article 10 can be of any conventional design or style in order to cooperate with the surrounding decor. Furniture article 10 includes a pair of armrests 42, as well as a chair back 44 and a chair base 46. Armrests 42 are covered with a removable pair of armrest covers 48 that have a conventional configuration and appearance. Chair back 44 is substantially upright and supports a back cushion 50. Chair base 46 supports a conventional seat cushion 54. A chair back cover 56 is removably draped over a top edge 58 of chair back 44 and back cushion 50. A base cover 60 is connected to chair base 46. The upper edge of base cover 60 is secured beneath seat cushion 54 so as to drape down along the front surface of chair base 46. Covers 48, 56 and 60 serve a dual purpose. In one sense covers 48, 56 and 60 operate as a wear inhibitors for those particular regions which are subject to an abnormal amount of rubbing an resultant wear. Covers 48, 56 and 60 also serve as a means of concealing handles 32, 33 and foot stirrups 34 when furniture article 10 is not in use in an exercise mode.

Furniture article 10 is supported by frame 12 as shown in FIGS. 3, 5 and 6. Frame 12 has a conventional furniture support construction with a set of frame members 62 that frame-in a hollow interior region 64. Frame members 62 may be composed of wood, steel or any other material while providing rigid support for article 10. Depending on the materials used to construct frame 12, frame members 62 are joined by conventional furniture construction techniques. Frame members 62 are covered by furniture webbing, springs and the like (not shown), which are in turn covered by furniture padding that blocks in the shape of furniture article 10 in conventional fashion. Cover 3 is preferably furniture upholstery that provides an aesthetically pleasing residential or office appearance to article 10. Thus, the upholstery material of cover 35 may vary according to the desires of the user, such as for example, cloth, leather, plastic or other materials which appeal to personal taste. Alternatively, cover 35 may be constructed of rigid or semi-rigid panels (not shown) that block in frame members 62 and enclose hollow interior region 64.

Exercise apparatus 14–16 are mounted on frame 12 within hollow interior section 64 and enclosed by cover 35. Preferably the three exercise apparatus include an armrest exercise apparatus 14, a chair back exercise apparatus and a chair base exercise apparatus 16. Armrest exercise apparatus 14 are generally vertically oriented within armrests 42 (FIG. 3), and chair back exercise apparatus 15 is generally vertically oriented within chair back 44 (FIG. 5). Chair base exercise apparatus 16 is generally horizontally oriented within chair base 46 (FIG. 6). In the preferred embodiment exercise apparatus 14, 15 and 16 operate in similar fashion, as described below, regardless of the orientation of the particular exercise apparatus 14–16.

Preferably each armrest exercise apparatus 14 (FIG. 3) includes one or more cables 18 and one or more resisting mechanism 22. A fixed end 69 of cable 18 is secured by a hook 70 on frame 12. Resisting mechanism 22 includes a set of fixed pulleys 71 and a set of spring loaded pulleys 72 mounted on frame 12. Each spring mounted pulley 72 is coupled to a spring 73 on frame members 62. Springs 73 allow pulleys 72 to be pulled away from frame members 62, but urge pulleys 72 back toward frame members 62 Fixed pulleys 71 and spring loaded pulleys 72 are mounted in staggered fashion on opposite vertical frame members 62. Cable 18 is threaded from hook 70 alternatingly through fixed pulleys 71 and spring loaded pulleys 72 in order to result in cable 18 having a zig-zag pattern of courses as cable 18 extends up into armrests 42.

In each armrest 42 is an armrest channel or aperture 74 through which cable 18 passes. Armrest aperture 74 opens up through a horizontal frame member 62 at the upper surface of armrest 42 and through cover 35. Cable 18 extends from resisting mechanism 22 out through armrest aperture 74 to a free end 75. Handle 32 is secured to free end 75 so as to be located outside of cover 35. Armrest aperture 74 is located at a forward region of armrest 42 so as to underlay the hand of a person resting on armrest 42. Armrest aperture 74 has a diameter large enough so that cable 18 may slide easily through aperture 74 during the exercising process, but small enough to prevent the passage of handle 32.

In use, a person seated on furniture article 10 grasps handle 32 and pulls cable 18 out through armrest aperture 74. As used herein, the grasping of a handle is considered to be "coupling" a user to the exercise equipment. As cable 18 is withdrawn, spring loaded pulleys 72 are drawn toward fixed pulleys 71 and springs 73 are extended. The spring force of springs 73 therefore resist the withdrawal of cable 18 by drawing spring loaded pulleys 72 away from fixed pulleys 71. Springs 73 bias handle 32 back toward armrest 42, and pulls handle 32 tightly against armrest 42 when exercise apparatus 14 is not in use. The resistive forces generated by exercise apparatus 14 may be varied by changing the spring constant of springs 73 provided in furniture article 10.

As shown in FIG. 3, a last alignment pulley 77 in the sequence of resisting mechanism 22 is mounted in vertical alignment with armrest aperture 74. Alignment pulley 77 is in a fixed position so as to maintain the alignment of cable 18 with armrest aperture 74 as cable 18 is withdrawn and handle 32 retracted. Most preferably cable 18 is approximately ten feet long with each course between pulleys 71 and 72 being approximately two feet. Most preferably pulleys 71 and 72 are approximately three quarters of an inch in diameter, while springs 73 are approximately one inch in diameter and approximately four inches long.

As shown in FIGS. 2–4, handle 32 is a short cylindrical dowel or rod having a diameter that may be readily grasped by an average sized hand. Cable 18 splits at outer free end 75 in order to be tied or otherwise secured at either end of handle 32. A storage bracket 79 is mounted on the forward surface of armrest 42 by screws or other suitable fasteners. Bracket 79 is a downwardly opening hook or fastener under which handle 32 may be seated when in a stored position (FIG. 4). Resisting mechanism 22 urges the retraction of cable 18 back through armrest aperture 74 so that handle 32 is snubbed up into hook 81. Storage bracket 79 serves to tautly hold handle 32 out of the way and store handle 32 off of the upper surface of armrest 42. Handle 32 therefore does not provide an uncomfortable bulge on the upper surface of armrest 42 which a person's arm or hand would otherwise rest on. As shown in FIG. 1, armrest cover 48 includes a front panel 80 that depends down across the forward surface of armrest 42, thus concealing both handle 32 and storage bracket 79 from sight.

Preferably each back exercise apparatus 15 (FIG. 5) includes one cable 19 and one resistive mechanism 23. A fixed end 82 of cable 19 is secured by a hook 83 on frame 12. Resisting mechanism 23 includes a set of fixed pulleys 84 and a set of spring loaded pulleys 85 mounted on frame 12. Each spring mounted pulley 85 is coupled to a spring 86 on frame members 62. Fixed pulleys 84 and spring loaded pulleys 85 are mounted in staggered fashion on opposite horizontal frame members 62. Cable 19 is threaded from hook 83 alternatingly through fixed pulleys 84 and spring loaded pulleys 85 in order to result in cable 19 having a vertically extending zig-zag pattern of courses between the upper region and lower region of chair back 44.

In chair back 44 is a chair back channel or aperture 88 through which cable 19 passes. Chair back aperture 88, opens up through a horizontal frame member 62 at the upper surface of chair back 44 and through cover 35. Cable 19 extends from resisting mechanism 23 out through back portion aperture 88 to a free end 89. Elongated handle 33 is secured to free end 89 so as to be located outside of cover 35. Chair back aperture 88 has a diameter large enough so that cable 19 may slide easily through chair back aperture 88 during the exercising process, but small enough to prevent the passage of elongated handle 33.

In use, a person seated on furniture article 10 grasps elongated handle 33 and pulls cable 19 upward through chair back aperture 88. Alternatively the person may stand behind furniture article 10 and grasp elongated handle 33 for exercising. As cable 19 is withdrawn, spring loaded pulleys 85 are drawn toward fixed pulleys 84 and springs 86 are extended. The spring force of springs 86 therefore resist the withdrawal of cable 19 by drawing spring loaded pulleys 85 away from fixed pulleys 84. Springs 86 bias elongated handle 33 back toward chair back 44, and pulls elongated handle 33 tightly against chair back 44 when exercise apparatus 15 is not in use. The resistive force generated by exercise apparatus 15 may be varied by changing the spring constant of springs 86 provided in furniture article 10. The final spring loaded pulley 86 is vertically aligned with chair back aperture 88. As cable 19 is withdrawn spring 86 for the final pulley 86 shifts generally vertically so as to remain in alignment with chair back aperture 88 and thus avoid binding.

As shown in FIG. 5, elongated handle 33 is a cylindrical dowel or rod having a diameter that may be readily grasped by an average sized hand. Cable 19 is conventionally affixed to the center point of elongated handle 33. Elongated handle 33 is preferably long enough to allow the user to grasp elongated handle 33 with both hands (FIG. 7), and accordingly exercise upper body portions.

Most preferably cable 19 is approximately then ten feet long, with each course extending between pulleys 84 and 85 being approximately two feet long. Most preferably pulleys 84 and 85 are approximately three quarters of an inch in diameter, while springs 86 are approximately four inches long and approximately one inch in diameter.

Preferably chair base exercise apparatus 16 (FIG. 6) includes one or more cables 20 and one or more resisting mechanism 24. A fixed end 91 of cable 20 is secured by a hook 92 on frame 12. Resisting mechanism 24 includes a fixed pulley 93 and a set of spring loaded pulleys 94 mounted on frame 12. Each spring mounted pulley is coupled to a spring 95 on frame members 62. Springs 95 allow pulleys 94 to be pulled away from frame member 62, but urge pulleys 94 back toward frame member 62. Hook 92, fixed pulley 93 and spring loaded pulleys 94 are mounted in staggered fashion on opposite horizontal frame members 62 at the front and back of chair base 46. Cable 20 is threaded from hook 92 alternatingly through fixed pulley 93 and spring loaded pulleys 94 resulting in cable 20 having a zig-zag pattern of courses as cable 20 extends toward the front of chair base 46.

In chair base 46 is a chair base channel or aperture 96. Chair base aperture 96 opens up through vertical frame member 62 at the front surface of chair base 46 and through cover 35. Cable 20 extends from resisting mechanism 24 out through chair base aperture 96 to a free end 97. Stirrup assembly 34 is secured to free end 97 so as to be located outside of cover 35. Chair base aperture 96 is located at a lower region of chair base 46 (FIG. 7) so as to be positioned laterally adjacent a lower portion of a person's legs when he or she is using furniture article 10. Chair base aperture 96 has a diameter large enough so that cable 20 may slide easily through aperture 96 during the exercising process, but small enough to prevent the passage of stirrup assembly 99. The final spring loaded pulley 94 is aligned with chair base aperture 96 to prevent binding as cable 20 is withdrawn.

In use, a person seated on furniture article 10 inserts a lower portion of one or both legs into stirrups 34 and pulls cable 20 out through chair base aperture 96. As cable 20 is withdrawn, spring loaded pulleys 94 are drawn toward fixed pulley 93 and springs 95 are extended. The spring force of springs 95 therefore resist the withdrawal of cable 20 by drawing spring loaded pulleys 94 away from fixed pulleys 93. Springs 95 bias stirrup assembly 34 tightly against chair base 46 when exercise apparatus 16 is not in use. The resistive forces generated by exercise apparatus 16 may be varied by changing the spring constant of springs 95 provided in furniture article 10. As shown in FIGS. 5–6, stirrup assembly 34 is comprised of a rigid elongated rectangular strip 101 to which flexible loops or straps 103 are conventionally attached. Preferably the openings in the stirrups 34 are such that the typical user can insert his or her lower leg or foot therein. Cable 20 is connected by conventional techniques to the midpoint of stirrup assembly 34 so that the user can easily exercise both legs if desired.

Most preferably cable 20 is approximately eight feet long, with each course extending between hook 92 and pulleys 93 and 94 being approximately two feet long. Most preferably springs 95 and pulleys 93 and 94 are dimensioned the same as the springs and pulleys disclosed above.

An alternative embodiment is shown in FIG. 8, in which a furniture article **10*a* is embodied in the form of a love seat or short couch. As will be recognized, furniture article 10*a* is constructed and operates in a fashion similar to previously described furniture article 10. Therefore, common elements of furniture article 10*a* are given reference numerals similar to the reference numerals of furniture article 10, with the exception of the addition of a suffix "a". Furniture article 10*a* therefore includes a frame 12*a* that defines a pair of armrests 42*a*, backs 44*a* and base 46*a*, all of which are covered by a cover 35*a*. Furniture article 10*a* differs from the previous embodiment of furniture article 10, in that backs 44*a* and base 46*a* are elongated and a dual exercise system is incorporated into furniture article 10*a* such that two persons may be seated side by side and either simultaneously or independently exercise on article 10*a***.

Furniture article **10*a* therefore has two internal armrest exercise apparatus (not shown), two internal back exercise apparatus (not shown) as well as two internal chair base exercise apparatus (not shown). The armrest exercise apparatus is coupled to the user by way of cables 18*a* to which handles 32*a* are attached. The back exercise apparatus is coupled to the user by way of cables 19*a* to which handles 33*a* are connected. The chair base exercise apparatus is coupled with the user by way of cables 20*a* to which stirrup assemblies 34*a* are connected. As illustrated in FIG. 8, since there is no armrest in between the two seat cushions 54*a*, two of middle cables 18*a* do not pass through armrests 42*a*. Consequently, although furniture article 10*a* functions in the same way as two of furniture article 10 placed side by side, two centrally located handles 32*a* extend to the user via a space 105 formed between cushions 54*a*. When not in use, the centrally located cables 18*a* are retracted by resistive mechanisms 22*a* (not shown), so that centrally located handles 32*a* are conveniently stored within the space 105 and concealed by seat cushions 54*a*. Armrests 42*a* are covered with removable armrest covers 48*a* having a conventional configuration and appearance. Chair back covers 56*a* are removably draped over a top edge of chair backs 44*a* as well as back cushions 50*a*. Base covers 60*a* are connected to chair base 46*a*. The upper edges of base covers 60*a* are secured beneath seat cushions 54*a* so as to drape down along the front surface of chair base 46*a*. As with furniture article 10, covers 48*a*, 56*a* and 60*a* serve a dual purpose. Not only do the covers 48*a*, 56*a* and 60*a* operate as wear inhibitors, but also serve as means of concealing handles 32*a* and 33*a* as well as foot stirrup assemblies 34*a* when furniture article 10*a*** is not in use in the exercise mode.

Still another embodiment is shown in FIG. 9, in which a different type of mechanism is used to resist the withdrawal of cable 19 from chair back 44. In the embodiment of FIG. 9, a configured cam 200 is pivotally mounted on a cross brace 202 extending between frame member 62. Cable 19 extends along a fixed pulley 199 down to cam 200 and is wrapped around a cam surface thereon (not shown), while a weight cable 204 is wrapped around the outer cam surface of configured cam 200. A stacked set of weights 206 are slidably stacked between containment brackets 208 in a lower region of chair back 44. A rigid coupling bar 210 is slidably received down through a central aperture in weights 206. Bar 210 has a vertical arrayed series of apertures (not shown) that correspond to a set of selection apertures 212 in the face of weights 206. A weight selection pin 214 is inserted through selection apertures 212 of weights 206 and the selection apertures of rigid bar 210 in order to lock a selected number of weights to rigid bar 210.

Cam 200 is configured so as to vary the moment arm between the cam pivot and weight cable 204, thus varying the effective resistance exerted by weights 206. Cam 200 is configured so as to compliment the motion of a person's arm as they move through certain preselected exercises. Cover 35 includes a weight selection slot (not shown) that is positioned immediately adjacent selection apertures 212, so that a person may insert weight selection pin 214 through cover 35 and into weight selection apertures 212.

The construction of furniture article 10 is particularly well adapted for use in the home or office. Furniture article 10 is economical in that it serves multiple functions. On one hand it is a comprehensive exercise device compactly contained within a single unit. A person can exercise various muscle groups throughout the entire body by use of the several exercise apparatus 14–16. At the same time it is not necessary to have the numerous machines that it would ordinarily require to provide all of the functions that furniture article 10 provides. On the other hand furniture article 10 is a piece of ornamental and functional furniture, so that, when not is use, it readily blends into the home or office environment. Consequently, a person need not go to an exercising facility in order to exercise, and a person may exercise in conjunction with the amenities of the home. For example, the user may perform other activities while using the exercise aspects of furniture article 10, such as watch television or the like. The user may also intersperse other activities with his or her exercise activities. Since furniture article 10 is designed for use in the home or office, it need not be kept in a remote area, so that use of furniture article 10 will be encouraged in order to exercise on a regular basis. Thus, the goal of retaining physical fitness is obtained without the necessity of possessing machines distracting from the environment of the home or office.

It is to be understood that this invention may assume various alternative orientations and step sequences not specifically described herein. Differences resistance mechanisms may be employed, and the exercise apparatus may be incorporated in other furniture articles for seating, such as benches, stools or the like, as well as in other non-seating articles such as cabinets, desks, end tables and the like. It is also to be understood that the specific devices and procedures illustrated and described herein are simply exemplary embodiments of the inventive concepts defined in the appended claims. Hence, specific dimensions, and other physical characteristics relating to the embodiments disclosed herein are not to be considered as limiting.

From the foregoing description, it will be appreciated by those skilled in the art that modifications or improvements may be made to the preferred embodiments disclosed herein without departing from the concepts disclosed. The scope of protection afforded is to be determined by the claims which follow and the breadth of interpretation that the law allows.

The embodiments of the invention in which an exclusive property or privilege is claimed are defined as follows:

1. A furniture article for use in physical exercise, comprising:

a furniture article frame defining a seating article having a seat and at least one raised armrest;

an armrest exercise element mounted on said frame, said exercise element having means for coupling said armrest exercise element to a person using said furniture article, said armrest exercise element adapted to provide selective movement of said armrest coupling means generally away from said frame and generally toward said frame;

means for resisting movement of said armrest coupling means away from said frame;

means for selectively covering said frame and said resisting means so as to provide said furniture article with the appearance of a conventional furniture article used in residences and offices;

said armrest having an armrest aperture through which said armrest exercise element slidably extends from within said covering means to a region outside of said covering means, whereby said furniture provides a dual function of providing a user with the ability to selectively exercise at least one body region with said furniture article with said resisting means providing an exercise force, and also providing an aesthetically pleasing furniture article having an appearance typically associated with residences and offices.

2. The furniture article of claim 1, wherein:

said exercise element comprises an elongated, flexible member mounted so as to selectively extend outside of said covering means.

3. The furniture article of claim 2, wherein:

said coupling means is disposed outside of said covering means when said coupling means is coupled to said user;

said resisting means urges said elongated flexible member into said covering means such that said coupling means is urged toward said frame.

4. The furniture article of claim 3, wherein:

said flexible member is a cable;

said resisting means includes a spring coupled to said frame and said cable so as to urge s id cable into said covering means.

5. The furniture article of claim 4, wherein:

said resisting means includes at least one pulley coupled to said frame and said cable running about said pulley.

6. The furniture article of claim 5, wherein:

said frame and said covering means includes at least one cable channel therethrough, said cable slidably extending through said cable channel;

said pulley is mounted on said frame in alignment with said cable channel, said cable extending linearly from said pulley out through said cable channel whereby the tracking of said cable is facilitated as said cable is pulled out of or retracted into said frame.

7. The furniture article of claim 5, further comprising:

a plurality of said pulleys coupled to said frame.

8. The furniture article of claim 7, wherein:

at least one of said pulleys is mounted on said spring such that said pulley extends said spring as said coupling means is moved away from said frame.

9. The furniture article of claim 3, wherein:

said coupling means includes a handle;

said resisting means biases said handle against said covering means and said frame, whereby said elongated flexible member is substantially stored within said frame.

10. The furniture article of claim 9, wherein:

said frame and covering means define a seating article having a back, said back having a back aperture through said covering means, with said flexible member slidably extending through said back aperture.

11. The furniture article of claim 3, wherein:

said coupling means includes a foot stirrup;

said resisting means biases said foot stirrup against said covering means and said frame, whereby said elongated flexible member is stored substantially within said frame.

12. The furniture article of claim 11, wherein:

said frame and covering means define a seating article having a seating base with a forward side, said seating base forward side having an aperture through said covering means with said flexible member slidably extending through said aperture.

13. A furniture article for use in physical exercise, comprising:

a furniture article frame;

an exercise element mounted on said frame, said exercise element comprising an elongated, flexible member, said exercise element having means for coupling said exercise element to a person using said furniture article and including a handle, said exercise element adapted to provide selective movement of said coupling means generally away from said frame and generally toward said frame;

means for resisting movement of said coupling means away from said frame;

means for selectively covering said frame and said resisting means so as to provide said furniture article with the appearance of a conventional furniture article used in residences and offices;

said flexible member mounted so as to selectively extend outside of said covering means with said coupling means disposed outside of said covering means when said coupling means is coupled to said user;

said resisting means urging said elongated flexible member into said covering means such that said coupling means is urged toward said frame, and said resisting means biasing said handle against said covering means and said frame, whereby said elongated flexible member is substantially stored within said frame;

said frame and covering means defining a seating article having an armrest, said armrest having an aperture through which said flexible member slidably extends from within said covering means to a region outside of said covering means, whereby said furniture provides a dual function of providing a user with the ability to selectively exercise at least one body region with said furniture article with said resisting means providing an exercise force, and also providing an aesthetically pleasing furniture article having an appearance typically associated with residences and offices.

14. The furniture article of claim 13, wherein:

said armrest has an upper region adapted to support the arm of a user;

means for selectively storing said handle away from said armrest upper region.

15. The furniture article of claim 1, wherein:

said armrest has an upper region adapted to support the arm of a user;

means for selectively storing said coupling means away from said armrest upper region.

16. The furniture article of claim 1, further comprising:

said furniture article defining a generally vertical block with a back aperture therethrough;

a back exercise element mounted on said frame so as to slidably extend through said back aperture, said back exercise element having means for coupling said back exercise element to a person using said furniture article;

means for resisting movement of said back coupling means away from said frame.

17. The furniture article of claim 16, further comprising:

said seat having a forward aperture on the forward surface thereof;

a lower exercise element mounted on said frame so as to slidably extend through said lower aperture, said lower exercise element having means for coupling said lower exercise element to a person using said furniture article;

means for resisting movement of said back coupling means away from said frame.

18. The furniture article of claim 17, further comprising:

means for selectively concealing said armrest coupling means, said back coupling means and said lower coupling means when said furniture article is not in use for exercising.

19. A furniture article for use in exercising, comprising:

a covered furniture frame having an exterior appearance typically associated with residences and offices;

an exercise element mounted within said frame and extending outside of said frame, said exercise element comprising an elongated flexible member mounted so as to selectively extend outside of said covered furniture frame, said exercise element having means for coupling said exercise element to a person using said exercise article and including a handle, said coupling means disposed outside of said frame and said coupling means having a stored condition and a use condition, and said exercise element adapted to provide selective movement of said coupling means generally away from said frame and generally toward said frame;

means for resisting movement of said coupling means generally away from said frame, said resisting means urging said elongated flexible member into said covered furniture frame such that said coupling means is urged toward said furniture frame and said handle is biased against said covered furniture frame, whereby said elongated flexible member is substantially stored within said frame;

means for selectively concealing said coupling means when in said stored condition, whereby the aesthetic appearance of said furniture article is enhanced having an appearance typically associated with residences and offices;

said covered furniture frame defining a seating article having an armrest, said armrest having an upper region adapted to support the arm of a user;

means for selectively storing said handle away from said armrest upper region;

said concealing means including an armrest cover configured to conceal said handle when in a storing condition and configured to conceal said storing means.

20. A furniture article for use in exercising, comprising:

a covered furniture frame having an exterior appearance typically associated with residences and offices;

an exercise element mounted within said frame and extending outside of said frame, said exercise element comprising an elongated flexible member mounted so as to selectively extend outside of said covered furniture frame, said exercise element having means for coupling said exercise element to a person using said furniture article and including a foot stirrup, said coupling means disposed outside of said frame and said coupling means having a stored condition and a use condition, and said exercise element adapted to provide selective movement of said coupling means generally away from said frame and generally toward said frame;

means for resisting movement of said coupling means generally away from said frame, said resisting means urging said elongated flexible member into said covered furniture frame such that said coupling means is urged toward said furniture frame and said foot stirrup is biased against said covered furniture frame;

means for selectively concealing said coupling means when in a stored condition, said concealing means including a base front cover configured to conceal said foot stirrup, whereby the aesthetic appearance of said furniture article is enhanced having an appearance typically associated with residences and offices.

21. A seating article for residential and office use, comprising:

a covered seating article frame defining a hollow interior region and a cable aperture opening into said hollow interior region, said covered seating article frame have an aesthetically pleasing appearance typically associated with residences and offices;

a cable having a first end secured to said frame in said hollow interior region and said cable extending through said cable aperture to a second end disposed outside of said covered seating frame;

a cable withdrawal resisting element coupled to said cable and disposed in said hollow interior region, said cable withdrawal resisting element adapted to resist the withdrawal of said cable through said cable aperture;

a coupler element coupled to said cables second end such that said cable is provided with the ability to be selectively withdrawn through said cable aperture by said coupler element, said cable second end having a stored condition and a use condition;

a cover movably mounted on said conveyed seating article frame, said cover located and configured so as to selectively cover said cable aperture, said cable second end and said coupler element when said cable second end is in a stored condition, but said cover movable so as to provide access to said one of said coupler element in said use condition, whereby said seating article functions both as an exercise device and an aesthetically pleasing furniture article.

22. The seating article of claim 21, wherein:

said cable withdrawal resisting element urges said cable into said covered seating article such that said cable is urged toward the seating article frame.

23. The seating article of claim 22, wherein:

said cable withdrawal resisting element includes a spring coupled to the seating article frame and said cable so as to urge said cable into the seating cover.

24. The furniture article of claim 23, wherein:

said cable withdrawal resisting element includes at least one pulley coupled to the seating article frame with said cable running about said pulley.

25. The seating article of claim 24, wherein:

said pulley is mounted on said seating article frame in alignment with said aperture, said cable extending linearly from said pulley out through said aperture whereby the tracking of said cable is facilitated as said cable is pulled out of or retracted into said seating article.

26. The furniture article of claim 24, further comprising:

a plurality of said pulleys coupled to the seating article frame.

27. The furniture article of claim 26, wherein:

at least one of said pulleys is mounted on said spring such that said pulley extends said spring as said coupler element is moved away from said seating article frame.

28. The seating article of claim 22, wherein:

said coupler element is a handle; said cable withdrawal resisting element biases said handle against said covered seating article frame.

29. The furniture article of claim 28; wherein:

said covered seating article frame includes an armrest having an upper region adapted to support the arm of a user;

means for selectively storing said handle away from said arm rest upper region.

30. The furniture article of claim 29, wherein:

said cover configured to cover said handle when in said storing condition and said storing means.

31. The furniture article of claim 22, wherein:

said coupler element is a foot stirrup;

said cable withdrawal resisting element biases said foot stirrup against said covered seating article frame.

* * * * *

UNITED STATES PATENT AND TRADEMARK OFFICE

CERTIFICATE OF CORRECTION

PATENT NO. : 4,913,423

DATED : April 3, 1990

INVENTOR(S) : Mitchell R. Farran, et al.

It is certified that error appears in the above-identified patent and that said Letters Patent is hereby corrected as shown below:

Column 4, Line 9
"rubbing an" should be --rubbing and--

Column 4, Line 25
"Cover 3" should be --Cover 35--

Column 4, Line 57
After "62" insert --.--

Column 10, Line 14
"s id" should be --said--

Column 13, Claim 21, Line 30
"conveyed" should be --covered--

Signed and Sealed this

Seventeenth Day of March, 1992

*Attest:*

HARRY F. MANBECK, JR.

*Attesting Officer*

*Commissioner of Patents and Trademarks*